US009508534B2

(12) United States Patent
Silivra et al.

(10) Patent No.: US 9,508,534 B2
(45) Date of Patent: Nov. 29, 2016

(54) SYSTEMS AND METHODS FOR CALIBRATING GAIN IN AN ELECTRON MULTIPLIER

(71) Applicant: Thermo Finnigan LLC, San Jose, CA (US)

(72) Inventors: Oleg Silivra, Milpitas, CA (US); Harald Oser, San Carlos, CA (US); Joshua T. Maze, Round Rock, TX (US)

(73) Assignee: Thermo Finnigan LLC, San Jose, CA (US)

( * ) Notice: Subject to any disclaimer, the term of this patent is extended or adjusted under 35 U.S.C. 154(b) by 25 days.

(21) Appl. No.: 14/535,937

(22) Filed: Nov. 7, 2014

(65) Prior Publication Data

US 2016/0133448 A1 May 12, 2016

(51) Int. Cl.

| | |
|---|---|
| ***H01J 49/26*** | (2006.01) |
| ***H01J 49/00*** | (2006.01) |
| ***H01J 49/02*** | (2006.01) |
| *H01J 43/04* | (2006.01) |

(52) U.S. Cl.

CPC ..... *H01J 49/0009* (2013.01); *H01J 49/025* (2013.01); *H01J 43/04* (2013.01)

(58) Field of Classification Search

CPC .. H01J 49/26; H01J 49/0009; H01J 49/0027; H01J 49/0036; H01J 49/0095; H01J 49/025

See application file for complete search history.

(56) References Cited

U.S. PATENT DOCUMENTS

2009/0294654 A1* 12/2009 Steiner ..... H01J 49/025 250/283
2012/0032072 A1* 2/2012 Quarmby ..... H01J 49/025 250/282

OTHER PUBLICATIONS

Anonymous, "Agilent 6100 Series Quadrupole LC/MS Systems—Concepts Guide," http://www.agilent.com/cs/library/usermanuals/public/G1960-90079_6100_Concepts.pdf, Agilent Corporation, (2011), pp. 42-55.

Bruins, "A Simple and Inexpensive Modification of a Finnigan 3300 Quadrupole Mass Spectrometer for Negative Ion Detection," Biomedical Mass Spectrometry, vol. 10, No. 1, 1983, pp. 46-49.

Hakamata, et al., "Photomultiplier Tubes: Basics and Applications," https://www.hamamatsu.com/resources/pdf/etd/PMT_handbook_v3aE.pdf, Hamamatsu Photonics K.K., 2007, pp. 221-232.

* cited by examiner

*Primary Examiner* — David Porta
*Assistant Examiner* — Faye Boosalis
(74) *Attorney, Agent, or Firm* — David A. Schell

(57) ABSTRACT

Method for operating a mass spectrometer includes supplying a quantity of ions to an ion detector. The ion detector can include a conversion dynode operating in a first polarity and an electron multiplier. The method further includes adjusting the gain of the electron multiplier to determine a first set of calibration parameters, and calculating a second set of calibration parameters for the electron multiplier from the first set of calibration parameters. The second set of calibration parameters are for a second polarity of the conversion dynode. The method can further include configuring the ion detector to operate at the second polarity based on the second set of calibration parameters, and supplying ions of the second polarity to the mass spectrometer, and detecting an ion at a particular mass to charge ratio using the ion detector.

24 Claims, 5 Drawing Sheets

SYSTEMS AND METHODS FOR CALIBRATING GAIN IN AN ELECTRON MULTIPLIER

FIELD

The present disclosure generally relates to the field of mass spectrometry including systems and methods for calibrating gain in an electron multiplier.

INTRODUCTION

Mass spectrometry (MS) is widely used for identifying and quantifying compounds in a sample. In mass spectrometry, ions are separated on the according to their mass/charge (m/z) ratios, and ion abundances area measured as a function of m/z. Generally, a mass spectrometer has three major components; an ion source for producing ions, a mass analyzer for separating ions by m/z, and a detector for detecting the m/z separated ions. In an exemplary embodiment, the detector can include a conversion dynode for generating electrons responsive to the impingement of ions thereon, an electron multiplier for amplifying the electrons released from the conversion dynode to produce a detectable and measurable current, and an electrometer for measuring and recording the detected current.

Generally, the sensitivity of the electron multiplier can degrade over the lifetime of the ion multiplier. Periodic recalibration of the electron multiplier can be necessary to maintaining the sensitivity and accuracy of the ion detector.

As ions can carry either a net positive charge or a net negative charge, mass spectrometer systems can operate in either a positive ion mode or a negative ion mode, selecting for and analyzing ions of the appropriate charge. In practice, a system may operate exclusively in one mode for a significant portion of the lifetime of the electron multiplier. Without periodic recalibration in the alternative mode, the calibration for the alternative mode can become increasingly out of date, and it can become difficult to recalibrate the electron multiplier in the alternative mode.

From the foregoing it will be appreciated that a need exists for improved systems and methods for calibrating gain in an electron multiplier.

SUMMARY

In a first aspect of the disclosure, a method of operating a mass spectrometer, can include supplying a quantity of ions to an ion detector. The ion detector can include a conversion dynode operating in a first polarity and an electron multiplier. The method can further include adjusting the gain of the electron multiplier to determine a first set of calibration parameters, and calculating a second set of calibration parameters for the electron multiplier from the first set of calibration parameters. The second set of calibration parameters being for a second polarity of the conversion dynode. The method can further include configuring the ion detector to operate at the second polarity based on the second set of calibration parameters, supplying ions of the second polarity to the mass spectrometer, and detecting an ion at a particular mass to charge ratio using the ion detector.

In various embodiments of the first aspect, the method can further include calibrating the electron multiplier when the ion detector is operating in the second polarity using the second set of calculated calibration parameters as a starting point.

In various embodiments of the first aspect, the first polarity can be a positive polarity and the second polarity can be a negative polarity. In an alternate embodiment, the first polarity can be a negative polarity and the second polarity can be a positive polarity.

In various embodiments of the first aspect, the first set of calibration parameters model a gain function of the electron multiplier.

In various embodiments of the first aspect, the second set of calibration parameters can be calculated to prevent saturation or overloading of the electron multiplier when the ion detector is operated in the second polarity.

In various embodiments of the first aspect, the second set of calibration parameters are calculated to trigger a recalibration of the electron multiplier when the ion detector is operated in the second polarity.

In various embodiments of the first aspect, a function of a calibrated voltage in the first polarity, a function of a calculated voltage in the second polarity, or a voltage offset exceeds a threshold.

In various embodiments of the first aspect, exceeding a threshold by a function of a calibrated voltage in the first polarity, by a function of a calculated voltage in the second polarity, or by a voltage offset can trigger resetting calibration parameters to safe values.

In various embodiments of the first aspect, the second set of calibration parameters can be calculated to ensure ion signal is sufficient for a stable ion detection and electron multiplier calibration when the ion detector is operated in the second polarity.

In a second aspect, a mass spectrometer system can include an ion source configured to ionize a sample for analysis, a mass analyzer configured to separate ions based on a mass to charge ratio, an ion detector including a conversion dynode and an electron multiplier, and a controller. The ion detector can be configured to detect ions from the mass analyzer. The controller can be configured to instruct the ion source to supply a quantity of ions to the ion detector operating at a first polarity, adjust the gain of the electron multiplier to determine a first set of calibration parameters, calculate a second set of calibration parameters of the electron multiplier from the first set of calibration parameters, the second set of calibration parameters being for a second polarity of the conversion dynode, configure the ion detector to operate at the second polarity based on the second set of calibration parameters, supplying ions of the second polarity to the mass spectrometer, and detecting a plurality of ions using the ion detector.

In various embodiments of the second aspect, the first polarity can be a positive polarity and the second polarity can be a negative polarity. In an alternate embodiment, the first polarity can be a negative polarity and the second polarity can be a positive polarity.

In various embodiments of the second aspect, the controller can be further configured to calibrate the electron multiplier when the ion detector is operating in the second polarity using the second set of calculated calibration parameters as a starting point.

In various embodiments of the second aspect, the first set of calibration parameters can model a gain function of the electron multiplier. In various embodiments of the second aspect, the second set of calibration parameters can model a gain function of the electron multiplier.

In various embodiments of the second aspect, the second set of calibration parameters can be calculated to prevent saturation or overloading of the electron multiplier when the ion detector is operated in the second polarity.

In various embodiments of the second aspect, the second set of calibration parameters can be calculated to trigger a recalibration of the electron multiplier when the ion detector is operated in the second polarity.

In various embodiments of the second aspect, a function of a calibrated voltage in the first polarity, a function of a calculated voltage in the second polarity, or a voltage offset exceeds a threshold.

In various embodiments of the second aspect, the controller can be configured to reset calibration parameters to safe values when by a function of a calibrated voltage in the first polarity, a function of a calculated voltage in the second polarity, or a voltage offset exceeds a threshold.

In various embodiments of the second aspect, the second set of calibration parameters can be calculated to ensure ion signal is sufficient for a stable ion detection and electron multiplier calibration when the ion detector is operated in the second polarity.

In a third aspect, a method of operating a mass spectrometer can include supplying a quantity of ions to an ion detector, and adjusting the gain of the electron multiplier to determine a first set of calibration parameters. The ion detector can include a conversion dynode operating in a first polarity and an electron multiplier. The method can further include calculating an ideal set of calibration parameters for the ion detector operating in the second polarity from the first set of calibration parameters, retrieving a second set of calibration parameters for the ion detector operating in a second polarity, and determining if an update condition is met based on the second set of calibration parameters and the ideal set of calibration parameters. The method can further include calculating and storing a third set of calibration parameters for the ion detector operating in the second polarity if the update condition is met, configuring the ion detector to operate at the second polarity based on the second set of calibration parameters, supplying ions of the second polarity to the mass spectrometer, and detecting a plurality of ions at a particular mass to charge ratio using the ion detector.

In various embodiments of the third aspect, the first polarity can be a positive polarity and the second polarity can be a negative polarity. In an alternate embodiment, the first polarity can be a negative polarity and the second polarity can be a positive polarity.

In various embodiments of the third aspect, the method can further include calibrating the electron multiplier when the ion detector is operating in the second polarity using the second set of calibration parameters as a starting point.

In various embodiments of the third aspect, the update condition can be met when a function of a calibrated voltage in the first polarity, a function of a calculated voltage in the second polarity, or a voltage offset exceeds a threshold.

In various embodiments of the third aspect, the first set of calibration parameters can model a gain function of the electron multiplier. In various embodiments of the third aspect, the ideal set of calibration parameters can model a gain function of the electron multiplier.

In various embodiments of the third aspect, the third set of calibration parameters can be calculated to prevent saturation or overloading of the electron multiplier when the ion detector is operated in the second polarity.

In various embodiments of the third aspect, the third set of calibration parameters can be calculated to trigger a recalibration of the electron multiplier when the ion detector is operated in the second polarity.

In various embodiments of the third aspect, exceeding a threshold by a function of a calibrated voltage in the first polarity, by a function of a calculated voltage in the second polarity, or by a voltage offset can trigger resetting calibration parameters to safe values.

In various embodiments of the third aspect, the second set of calibration parameters can be calculated to ensure ion signal is sufficient for a stable ion detection and electron multiplier calibration when the ion detector is operated in the second polarity.

DRAWINGS

For a more complete understanding of the principles disclosed herein, and the advantages thereof, reference is now made to the following descriptions taken in conjunction with the accompanying drawings, in which.

Figure 1:
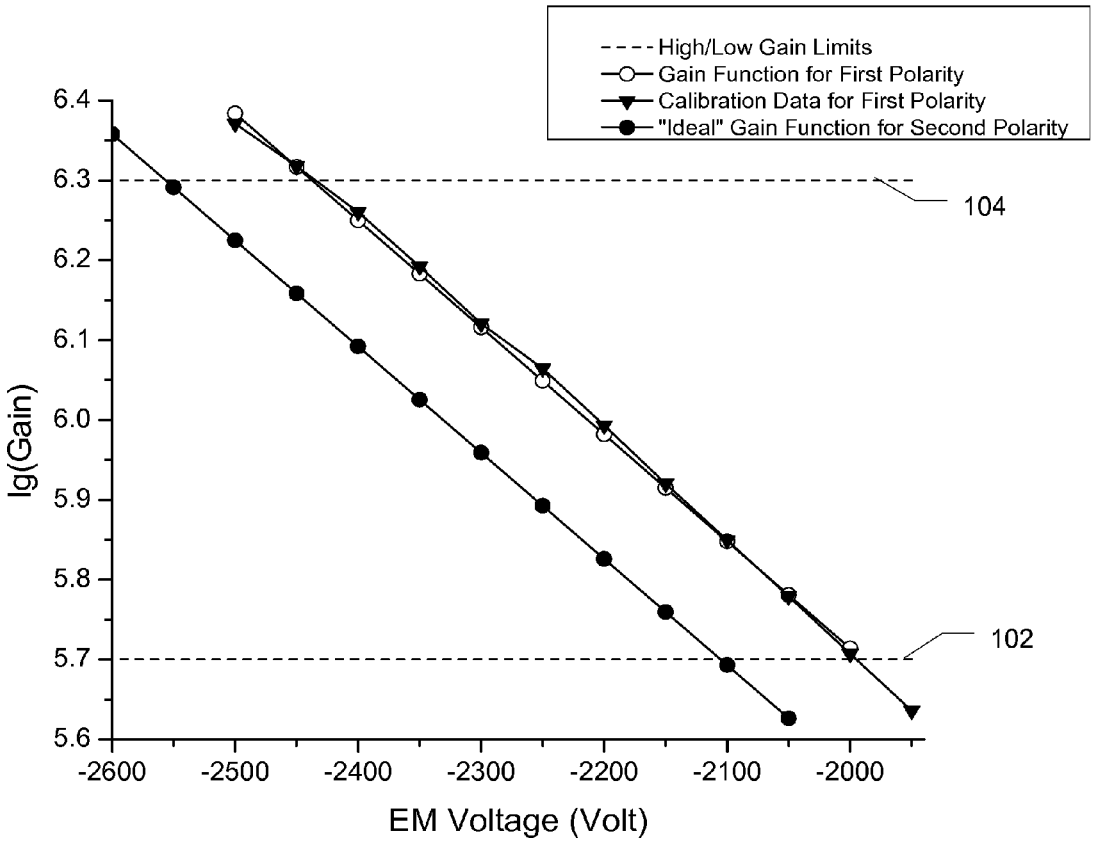
FIG. 1 is a graph illustrating exemplary gain curves for an electron multiplier operating in a positive polarity mode and a negative polarity mode, in accordance with various embodiments.

It is to be understood that the figures are not necessarily drawn to scale, nor are the objects in the figures necessarily drawn to scale in relationship to one another. The figures are depictions that are intended to bring clarity and understanding to various embodiments of apparatuses, systems, and methods disclosed herein. Wherever possible, the same reference numbers will be used throughout the drawings to refer to the same or like parts. Moreover, it should be appreciated that the drawings are not intended to limit the scope of the present teachings in any way.

DESCRIPTION OF VARIOUS EMBODIMENTS

Embodiments of systems and methods for calibrating an electron multiplier of a mass spectrometry system are described herein.

The section headings used herein are for organizational purposes only and are not to be construed as limiting the described subject matter in any way.

In this detailed description of the various embodiments, for purposes of explanation, numerous specific details are set forth to provide a thorough understanding of the embodiments disclosed. One skilled in the art will appreciate, however, that these various embodiments may be practiced with or without these specific details. In other instances, structures and devices are shown in block diagram form. Furthermore, one skilled in the art can readily appreciate that the specific sequences in which methods are presented and performed are illustrative and it is contemplated that the sequences can be varied and still remain within the spirit and scope of the various embodiments disclosed herein.

All literature and similar materials cited in this application, including but not limited to, patents, patent applications, articles, books, treatises, and internet web pages are expressly incorporated by reference in their entirety for any purpose. Unless described otherwise, all technical and scientific terms used herein have a meaning as is commonly understood by one of ordinary skill in the art to which the various embodiments described herein belongs.

It will be appreciated that there is an implied "about" prior to the temperatures, concentrations, times, number of bases, coverage, etc. discussed in the present teachings, such that slight and insubstantial deviations are within the scope of the present teachings. In this application, the use of the singular includes the plural unless specifically stated otherwise. Also, the use of "comprise", "comprises", "comprising", "contain", "contains", "containing", "include", "includes", and "including" are not intended to be limiting. It is to be understood that both the foregoing general description and the following detailed description are exemplary and explanatory only and are not restrictive of the present teachings.

As used herein, "a" or "an" also may refer to "at least one" or "one or more." Also, the use of "or" is inclusive, such that the phrase "A or B" is true when "A" is true, "B" is true, or both "A" and "B" are true. Further, unless otherwise required by context, singular terms shall include pluralities and plural terms shall include the singular.

A "system" sets forth a set of components, real or abstract, comprising a whole where each component interacts with or is related to at least one other component within the whole.

FIG. 1 is a graph illustrating the performance of an electron multiplier according to various embodiments. The electron multiplier can have a high gain limit 102 and a low gain limit 104. Above the high gain limit, the electron multiplier may become saturated or overloaded. Below the low gain limit, the electron multiplier may not produce sufficient signal to detect ions. Additionally, the graph illustrates gain calibration data for a first polarity and a gain function to model the calibration data of the first polarity. Further, the graph illustrates a calculated "ideal" gain function for a second polarity. Significantly, the gain function of the second polarity can be an offset of the gain function of the first polarity. The offset can be a characteristic of the electron multiplier and can be determined empirically.

In various embodiments, as the electron multiplier ages, the efficiency may degrade, such that the gain parameters need to be adjusted. A calibration procedure can be performed to update the gain function for the first polarity. However, when operated only in the first polarity for an extended period of time, saved calibration parameters for the second polarity may be out of date. In some instances, the saved calibration parameters for the second polarity can be so far off that insufficient signal is generated by the electron multiplier to perform a new calibration in the second polarity. In particular embodiments, the gain function for the first polarity can be used to calculate an ideal gain function for the second polarity, which can be used to update the saved gain parameters for the second polarity. In this way, the saved gain parameters for the second polarity can be maintained within a range to enable calibration in the second polarity, even after the electron multiplier is operated exclusively in the first polarity without periodic calibration in the second polarity.

Mathematical Formalism

In various embodiments, a gain function can be presented as a function depending on applied voltage U and two parameters, gain factor A and gain factor B $$G=G(A, B, U) \tag{1}$$

Parameter A can be used for normalization/scaling of gain function value and parameter B can be related to determination of the gain slope. In general this kind of functional assignments can be similar to the method of separation of variables widely used in mathematical physics.

The developed formalism can works for any model function satisfying description given for Eq.(1).

By way of an example, Eq.(2) can provide an explicit form of gain function $$G=A \exp\{B * U\} \tag{2}$$

Calibration of an electron multiplier can yield ($A_{pos}{}^{C}$, $B_{pos}{}^{C}$) values for positive mode and ($A_{neg}{}^{C}$, $B_{neg}{}^{C}$) values for negative mode. In various embodiments, solving equation G=Const with respect to U can yield EM voltage setting which provides requested gain for corresponding polarity:

$$G_{pos}(A_{pos}^{C}, B_{pos}^{C}, U_{pos}^{C\,H/L}) = \begin{cases} \text{high Gain} = 2\times10^{6} \\ \text{low Gain} = 5\times10^{5} \end{cases} \tag{3}$$

$$G_{neg}(A_{neg}^{C}, B_{neg}^{C}, U_{neg}^{C\,H/L}) = \begin{cases} \text{high Gain} = 2\times10^{6} \\ \text{low Gain} = 5\times10^{5} \end{cases} \tag{4}$$

where superscripts H, L refer to high and low Gain values of Exp.(3),(4).

In various embodiments, a calibration curve for negative polarity can be similar to the positive polarity curve but the negative polarity curve can be shifted by Delta volts toward more negative values. In various embodiments, the Delta can be approximately 100 V, but can depend on the electron multiplier.

In an embodiment where the positive polarity is calibrated but the negative polarity is outdated, the only reliable reference calibration values for the electron multiplier are those obtained in recently completed calibration: ($A_{pos}{}^{C}$, $B_{pos}{}^{C}$, $U_{pos}{}^{HC}$, $U_{pos}{}^{LC}$). An "ideal" gain function for negative polarity can be calculated by shifting the curve for positive polarity by −Delta.

$$\begin{cases} G_{neg}^{i}(A_{neg}^{i}, B_{neg}^{i}, U_{pos}^{CL} - \text{Delta}) = G_{pos}(A_{pos}^{C}, B_{pos}^{C}, U_{pos}^{CL}) & (5) \\ G_{neg}^{i}(A_{neg}^{i}, B_{neg}^{i}, U_{pos}^{CH} - \text{Delta}) = G_{neg}(A_{pos}^{C}, B_{pos}^{C}, U_{pos}^{CH}) & (6) \end{cases}$$

In explicit form, system (5,6) can be:

$$\begin{cases} A_{neg}^{i}\exp\{B_{neg}^{i}(U_{pos}^{CL} - \text{Delta})\} = A_{pos}^{C}\exp\{B_{pos}^{C} * U_{pos}^{CL}\} & (7) \\ A_{neg}^{i}\exp\{B_{neg}^{i}(U_{pos}^{CH} - \text{Delta})\} = A_{pos}^{C}\exp\{B_{pos}^{C} * U_{pos}^{CH}\} & (8) \end{cases}$$

In expressions (5)-(8) superscript "i" stands for "ideal". Dividing Eq.(7) by Eq.(8) one finds $$\exp\{B_{neg}{}^{i}(U_{pos}{}^{CL}-U_{pos}{}^{CH})\}=\exp\{B_{pos}{}^{C}(U_{pos}{}^{C}-U_{pos}{}^{CH})\} \tag{9}$$

It follows from Eq.(9) that $$B_{neg}{}^{i}=B_{pos}{}^{C} \tag{10}$$

Substitution of Eq.(10) into Eqs.(7) can yield $$A_{neg}{}^{i}=A_{pos}{}^{C}\exp\{\text{Delta}*B_{pos}{}^{C}\} \tag{11}$$

Thus, the "ideal" gain function can be expressed as $$G_{neg}{}^{i}=A_{pos}{}^{C}\exp\{B_{pos}{}^{C}(U+\text{Delta})\} \tag{12}$$

In various embodiments, a ratio of normal gain to minimal acceptable gain can be defined as N. As the observed intensity for a strong signal can be proportional to the ratio of nominal gain value to current gain value, N can describe a maximum allowable drop of intensity because of outdated electron multiplier gain calibration. As such, the parameters for the negative gain can be updated when the gain value estimated with the ideal function at a last calibrated voltage for the negative polarity is N times less than the nominal gain at this voltage:

$$G^i_{neg}(A^i_{neg}, B^i_{neg}, U^{COLD}_{neg}) \le \frac{1}{N} \text{ low Gain} \tag{13}$$

here and further superscripts H and L are omitted and all calculations can be done for low gain only, N is a positive number. $U_{neg}^{COLD}$ stands for EM voltage calculated for low gain using old values $A_{neg}^{COLD}$ and $B_{neg}^{COLD}$. For model function given by Eq.(2) this yields:

$$U^{COLD}_{neg} = \frac{1}{B^{COLD}_{neg}} \ln \frac{\text{low Gain}}{A^{COLD}_{neg}} \tag{14}$$

In various embodiments, updated gain calibration parameters can deliver a signal sufficient for mass or gain calibration to proceed but it should avoid multiplier overload or saturation. The target gain (denoted with superscript "t" thereafter) value can be a fraction of low Gain, say $$\frac{1}{M} \text{ low Gain,}$$

where M is a positive number. For the ideal gain function this happens at the voltage $U_{neg}^t$:

$$G^i_{neg}(A^i_{neg}, B^i_{neg}, U^t_{neg}) = \frac{1}{M} \text{ low Gain} \tag{15}$$

Solving Eq.(15) analytically or numerically can show $$U_{neg}^t = U_{neg}^t(A_{neg}^i, B_{neg}^i, \text{low Gain}/M) \tag{16}$$

The target gain function $G_{neg}^t$ can equal to low Gain when estimated at $U_{neg}^t$. This can result in an equation for $A_{neg}^t$:

$$G_{neg}^t(A_{neg}^t, B_{neg}^i, U_{neg}^t) = \text{low Gain} \tag{17}$$

By multiplying Eq.(15) by M and equating the result to LHS of Eq.(17)

$$MG_{neg}^i(A_{neg}^i, B_{neg}^i, U_{neg}^t) = G_{neg}^t(A_{neg}^t, B_{neg}^i, U_{neg}^t) \tag{18}$$

Solving Eq.(18), all unknowns ($A_{neg}^t$, $B_{neg}^i$, $U_{neg}^t$) can be expressed through recently calibrated values ($A_{pos}^C$, $B_{pos}^C$, $U_{pos}^C$). Using the explicit model of G given by Eq.(2):

$$A_{neg}^t = M \cdot A_{neg}^i \tag{19}$$

The gain function update can be derived from recently completed gain calibration in positive polarity:

$$G_{neg}^t = M \cdot A_{pos}^C \exp\{B_{pos}^C(U + \text{Delta})\} \tag{20}$$

The target voltage, $U_{neg}^t$, can be found using equality:

$$G_{pos}^C(A_{pos}^C, B_{pos}^C, U_{pos}^C) = G_{neg}^t(A_{pos}^C, B_{pos}^C, U_{neg}^t) \tag{21}$$

which yields $$U^t_{neg} = U^C_{pos} - \text{Delta} - \frac{1}{B^C_{pos}} \ln M \tag{22}$$

Finally, condition for update, Ex.(13), and updated values for gain factor A, Ex.(10), and gain factor B, Ex.(19), get the following explicit form $$\begin{cases} \exp\{B^C_{pos}(U^C_{pos} - U^{COLD}_{neg} - \text{Delta})\} \ge N & (23) \\ A^t_{neg} = M * A^C_{pos} * \exp\{\text{Delta} * B^C_{pos}\} & (24) \\ B^t_{neg} = B^C_{pos} & (25) \end{cases}$$

In an embodiment where the positive polarity is calibrated but the negative polarity is outdated, the updated gain function can be symmetrical to the previous case. The "Ideal" positive polarity gain function can be:

$$G_{pos}^i(A_{pos}^i, B_{pos}^i, U_{neg}^{CL} + \text{Delta}) = G_{neg}(A_{neg}^C, B_{neg}^C, U_{neg}^{CL}) \tag{26}$$

$$G_{pos}^i(A_{pos}^i, B_{pos}^i, U_{neg}^{CH} + \text{Delta}) = G_{neg}(A_{neg}^C, B_{neg}^C, U_{neg}^{CH}) \tag{27}$$

In explicit form:

$$\begin{cases} A^i_{pos}\exp\{B^i_{pos}(U^{CL}_{neg} + \text{Delta})\} = A^C_{neg}\exp\{B^C_{neg}U^{CL}_{neg}\} & (28) \\ A^i_{pos}\exp\{B^i_{pos}(U^{CH}_{neg} + \text{Delta})\} = A^C_{neg}\exp\{B^C_{neg}U^{CH}_{neg}\} & (29) \end{cases}$$

Eqs.(28,)(29) can yield $$B_{pos}^i = B_{neg}^C \tag{30}$$

$$A_{pos}^i = \exp\{-\text{Delta} * B_{neg}^C\} \tag{31}$$

Substituting Exps. (30), (31) into Eq.(2) can yield $$G_{pos}^i = A_{neg}^C \exp\{B_{neg}^C(U - \text{Delta})\} \tag{32}$$

Criterion to have an update can be:

$$G^i_{pos}(A^i_{pos}, B^i_{pos}, U^{COLD}_{pos}) \le \text{low Gain}/N, \tag{33}$$

$$\text{where } U^{COLD}_{pos} = \frac{1}{B^{COLD}_{pos}} \ln \frac{\text{low Gain}}{A^{COLD}_{pos}} \tag{34}$$

Target voltage, $U_{pos}^t$, for updated calibration can satisfy $$G^i_{pos}(A^i_{pos}, B^i_{pos}, U^t_{pos}) = \frac{1}{M} \text{ low Gain} \tag{35}$$

Solving Eq.(35) with respect to $U_{pos}^t$ can provide the EM voltage which provides desirable signal intensity.

Target gain function can satisfy the equality $$G_{pos}^t(A_{pos}^t, B_{pos}^i, U_{pos}^t) = \text{low Gain} \tag{36}$$

Exp.(36) can be an equation for The solution can be found similarly to the previously described and it satisfies the equation derived from combining Eq.(35) and Eq. (36).

$$M * G_{pos}^i(A_{pos}^i, B_{pos}^i, U_{pos}^t) = G_{pos}^t(A_{pos}^t, B_{pos}^i, U_{pos}^t) \tag{37}$$

For explicit form given by Eq.(2) the target gain function can be found as:

$$A_{pos}^t = M \cdot A_{pos}^i \tag{38}$$

$$G_{pos}^{t}=M\cdot A_{neg}^{C}\exp\{B_{neg}^{C}(U-\text{Delta})\} \quad (39)$$

The target voltage, $U_{pos}^{t}$, can correspondingly be found according to:

$$U_{pos}^{t} = U_{neg}^{C} + \text{Delta} - \frac{1}{B_{neg}^{C}}\ln M \quad (40)$$

In various embodiments, the condition for update, Ex. (33), and updated values for gain factor A, Ex.(38), and gain factor B, Ex.(30), can be as follows:

$$\begin{cases} \exp\{B_{pos}^{C}(U_{neg}^{C} - U_{pos}^{COLD} + \text{Delta})\} \geq N & (43) \\ A_{pos}^{t} = M \cdot \exp\{-\text{Delta} * B_{neg}^{C}\} \cdot A_{neg}^{C} & (44) \\ B_{pos}^{t} = B_{neg}^{C} & (45) \end{cases}$$

Figure 2:
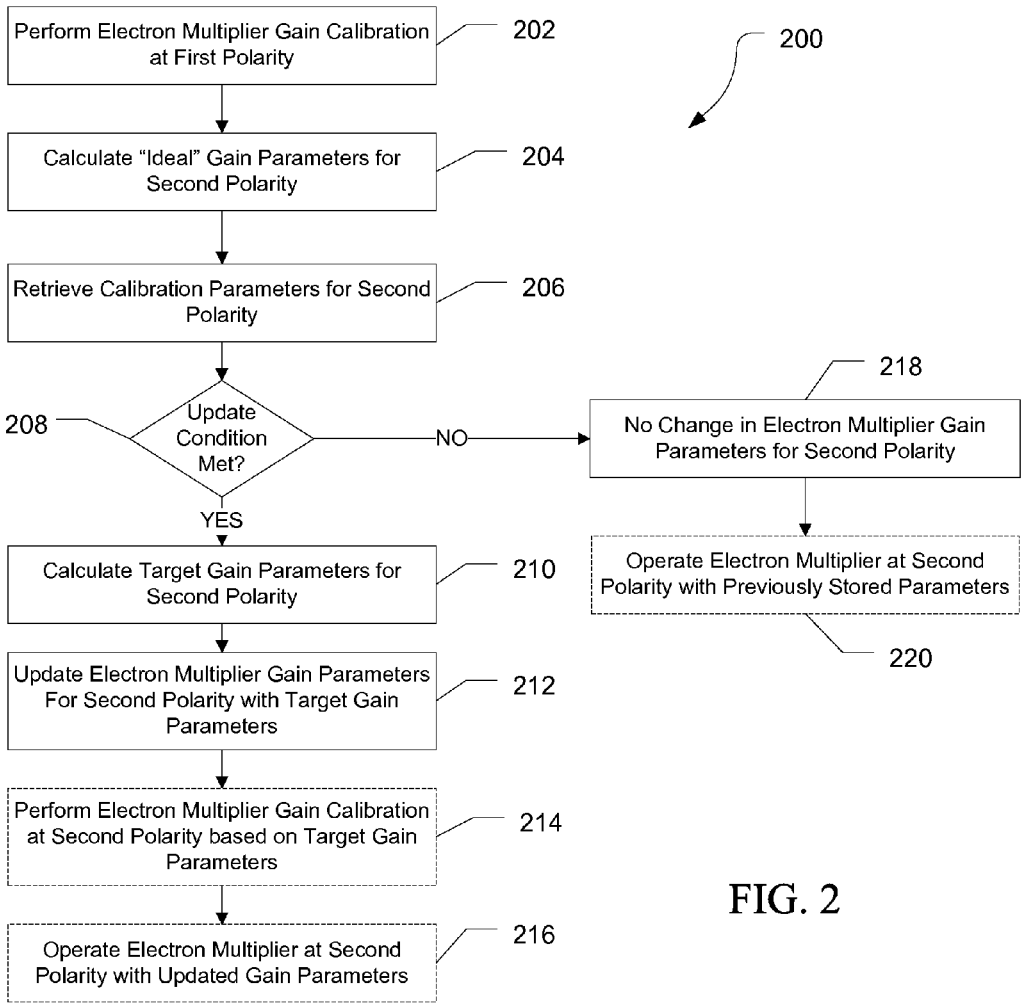
FIG. 2 is a flow diagram of an exemplary method for determining operating parameters for an electron multiplier, in accordance with various embodiments.

FIG. 2 is an exemplary flow diagram showing a method 200 for operating an ion detector of a mass spectrometer. At 202, an electron multiplier gain calibration is performed at a first polarity. The gain calibration can supply a known quantity of ions to an ion converting element that triggers ions to interact with the electron multiplier. The signal from the electron multiplier can be correlated to the known quantity of ions. The voltage of the electron multiplier can be adjusted to determine a gain curve for the first polarity. Additionally, the gain curve can be modeled to determine a set of parameters for a gain function to fit the gain curve for the first polarity.

At 204, a set of "ideal" gain parameters can be calculated for the second polarity based on the set of parameters determined when calibrating the gain at the first polarity.

At 206, calibration parameters for a second polarity can be retrieved. The calibration parameters for the second polarity may have been stored from the last time a gain calibration was performed on the electron multiplier for the second polarity. Alternately, the calibration parameters may have been calculated based on a previous calibration for the first polarity.

At 208, it can be determined if an update condition is met. In certain exemplary embodiments, this determination may be performed by assessing, using the ideal gain curve and the last calibrated voltage, if the nominal gain at the last calibrated voltage would be less than a minimal acceptable gain threshold. The minimal acceptable gain threshold may be a specified fraction of the normal gain, such as ⅛th of the normal gain. In various embodiments, when the nominal gain is less than the threshold, the electron multiplier may not generate sufficient signal at the last calibrated voltage to perform a calibration.

At 210, when the update condition is met, target gain parameters for the second polarity can be calculated. The target gain parameters can be calculated such that the signal produced would be higher than a minimal acceptable gain threshold, but lower than a saturation threshold. In various embodiments, the parameters can be calculated to generate a fraction of the ideal gain, such as ½ of the normal gain. In various embodiments, by calculating the parameters to generate a fraction of the ideal gain, a calibration of the electron multiplier can be forced when the electron multiplier is next used in the second polarity. Significantly, by updating the parameters, sufficient signal can be assured for calibration of the electron multiplier in the second polarity.

At 212, the electron multiplier gain parameters for the second polarity can be updated with the target gain parameters. The updated parameters can be stored for use when the electron multiplier is used in the second polarity.

At 214, the ion detector can be switched to the second polarity and, optionally, the electron multiplier gain calibration can be performed based on the target gain parameters to determine calibrated gain parameters for the second polarity. At 216, the calibration gain parameters for the second polarity can be used when operating the electron multiplier in the second polarity.

Returning to 208, when the update condition is not met, the electron multiplier gain parameters for the second polarity can be unchanged, at 218. The unchanged calibration gain parameters for the second polarity can be used when operating the electron multiplier in the second polarity, at 220.

Mass Spectrometry Platforms

Figure 3:
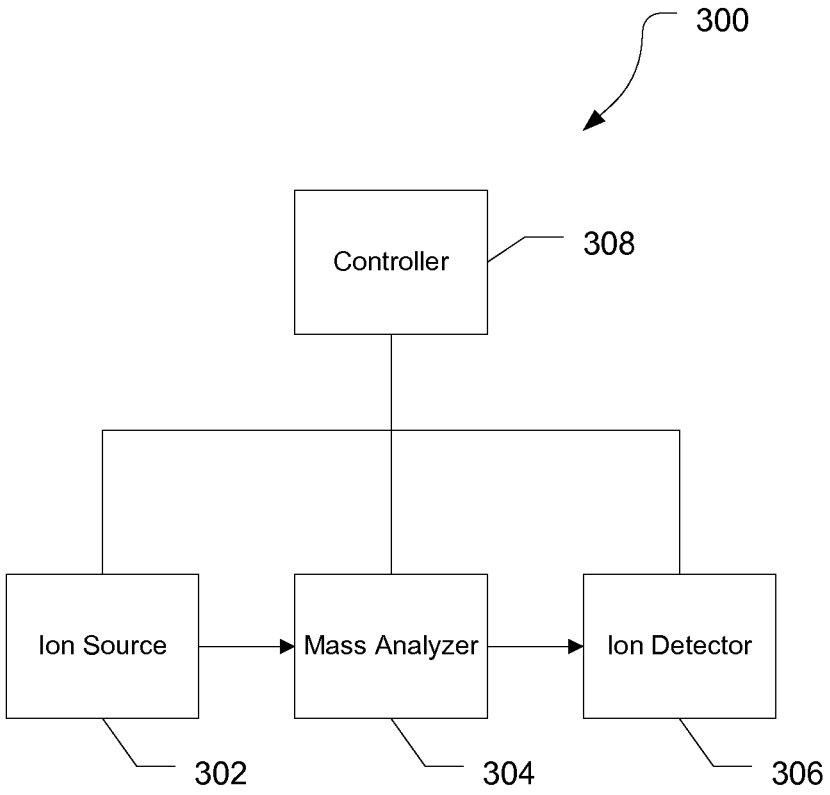
FIG. 3 is a block diagram of an exemplary mass spectrometry system, in accordance with various embodiments.

Various embodiments of mass spectrometry platforms can include components as displayed in the block diagram of FIG. 3. According to various embodiments, mass spectrometer 300 can include an ion source 302, a mass analyzer 304, an ion detector 306, and a controller 308.

In various embodiments, the ion source 302 generates a plurality of ions from a sample. The ion source can include, but is not limited to, a matrix assisted laser desorption/ionization (MALDI) source, electrospray ionization (ESI) source, inductively coupled plasma (ICP) source, electron ionization source, photoionization source, glow discharge ionization source, thermospray ionization source, and the like.

In various embodiments, the mass analyzer 304 can separate ions based on a mass to charge ratio of the ions. For example, the mass analyzer 304 can include a quadrupole mass filter analyzer, a time-of-flight (TOF) analyzer, a quadrupole ion trap, analyzer, an electrostatic trap (e.g., Orbitrap) mass analyzer, and the like. In various embodiments, the mass analyzer 304 can also be configured to fragment the ions and further separate the fragmented ions based on the mass-to-charge ratio.

In various embodiments, the ion detector 306 can detect ions. For example, the ion detector 306 can include an electron multiplier, a faraday cup, and the like. Ions leaving the mass analyzer can be detected by the ion detector. The ion detector may be quantitative, such that an accurate count of the ions can be determined.

In various embodiments, the controller 308 can communicate with the ion source 302, the mass analyzer 304, and the ion detector 306. For example, the controller 308 can configure the ion source or enable/disable the ion source. Additionally, the controller 308 can configured the mass analyzer 304 to select a particular mass range to detect. Further, the controller 308 can adjust the sensitivity of the ion detector 306, such as by adjusting the gain. Additionally, the controller 308 can adjust the polarity of the ion detector 306 based on the polarity of the ions being detected. For example, the ion detector 306 can be configured to detect positive ions or be configured to detected negative ions.

Electron Multiplier

Figure 4:
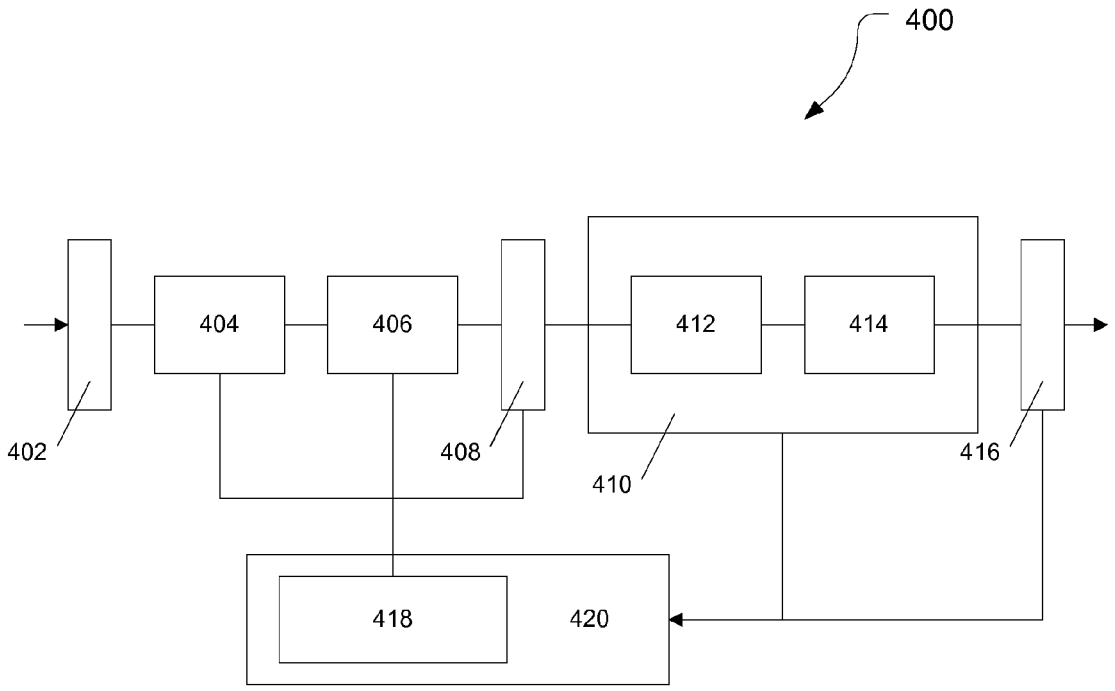
FIG. 4 is a block diagram illustrating an exemplary electron multiplier, in accordance with various embodiments.

FIG. 4 is a schematic representation of an exemplary ion detector assembly 400, which may be utilized for the ion detector 306 component of mass spectrometer 300 depicted in FIG. 3. The detector assembly 400 receives ions which emanate from an ion source (not shown) as either a beam of ions (continuous or non-continuous) or in pulses. The ions generated are either of or derived from a substance to be analyzed. The ions may be directed by conventional ion optics and/or mass analyzers 402 to the detection system.

Ion detection systems generally comprise an ion converting element 404 (for example a conversion dynode) followed by an electron multiplying element 406 (such as a continuous-dynode electron multiplier). In some implementations, the ions directly impinge the surface of the electron multiplying element 406, and consequently no ion-electron converting element 404 is required (such as in the case of a microchannel plate). A current measuring device 408, such as an anode combined with a pre-amplifier, is disposed to receive the particles produced by the electron multiplying element 406. An analog processing unit 418 is connected to the current measuring device 408 enabling the analog signal derived therefrom to be analyzed if required. A converting means 410 is provided to respond to the current flow generated in the current measuring device 408 to ultimately produce an output signal. The converting means can consist of an amplifier 412 and an ADC (Analog-to-Digital Converter) 414, for example. The ADC 414 generates a series of digital signals representative of the amplified signal. When passed to a digital signal processor 416, a representation of the intensity of the original ion beam spectrum can be attained. Some or all of the components of system 400 can be coupled to a system control unit, such as an appropriately programmed digital computer 420, which receives and processes data from the various components and which can be configured to perform detection analysis on the data received.

Computer-Implemented System

Figure 5:
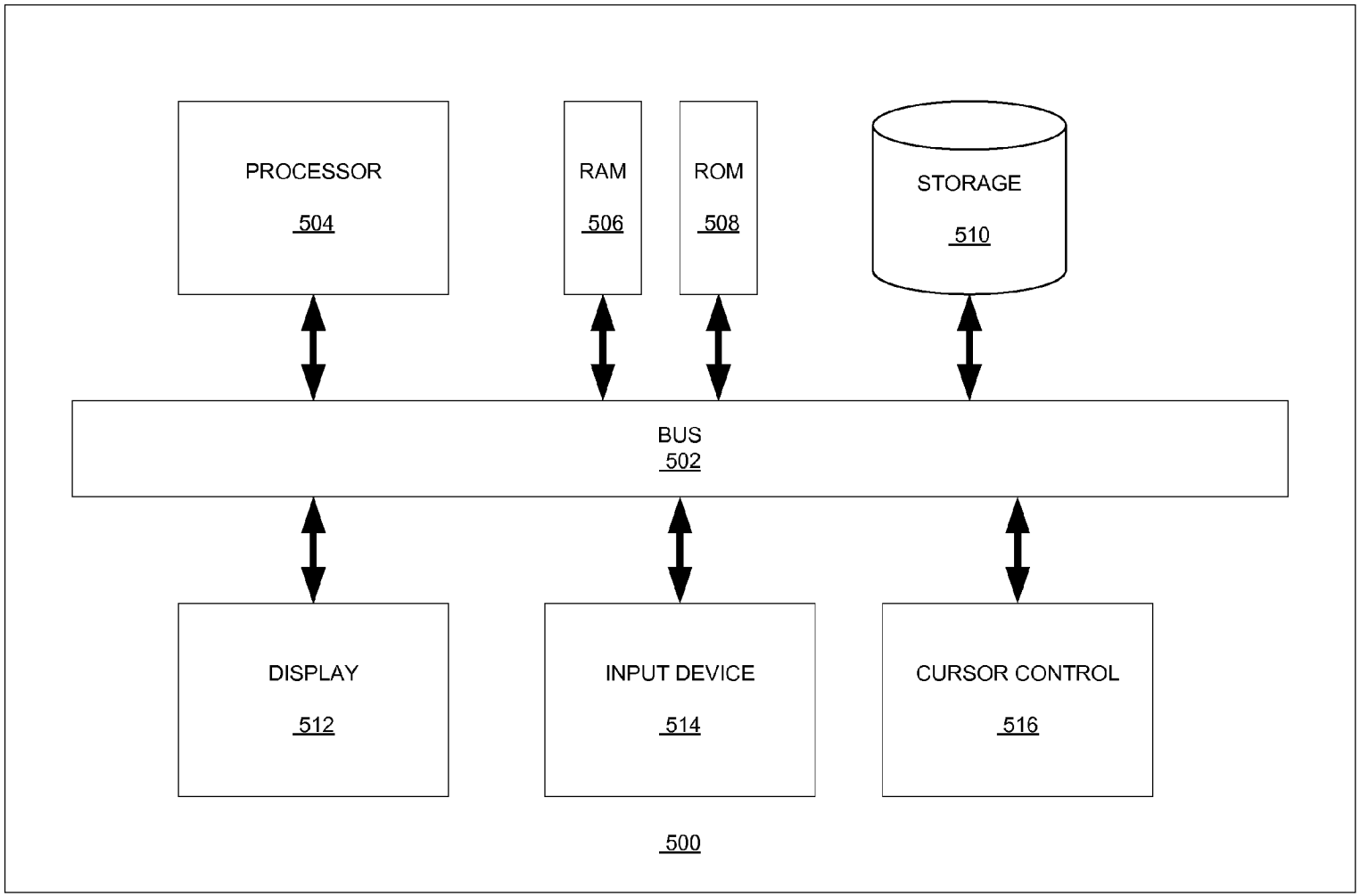
FIG. 5 is a flow block illustrating an exemplary computer system, in accordance with various embodiments.

FIG. 5 is a block diagram that illustrates a computer system 500, upon which embodiments of the present teachings may be implemented as which may form all or part of digital computer 420 of detector system 400 depicted in FIG. 4. Computer system 500 may incorporate or communicate with a system controller, for example controller 308 shown in FIG. 3, such that the operation of components of the associated mass spectrometer may be adjusted in accordance with calculations or determinations made by computer system 500. In various embodiments, computer system 500 can include a bus 502 or other communication mechanism for communicating information, and a processor 504 coupled with bus 502 for processing information. In various embodiments, computer system 500 can also include a memory 506, which can be a random access memory (RAM) or other dynamic storage device, coupled to bus 502 for determining base calls, and instructions to be executed by processor 504. Memory 506 also can be used for storing temporary variables or other intermediate information during execution of instructions to be executed by processor 504. In various embodiments, computer system 500 can further include a read only memory (ROM) 508 or other static storage device coupled to bus 502 for storing static information and instructions for processor 504. A storage device 510, such as a magnetic disk or optical disk, can be provided and coupled to bus 502 for storing information and instructions.

In various embodiments, processor 504 can include a plurality of logic gates. The logic gates can include AND gates, OR gates, NOT gates, NAND gates, NOR gates, EXOR gates, EXNOR gates, or any combination thereof. An AND gate can produce a high output only if all the inputs are high. An OR gate can produce a high output if one or more of the inputs are high. A NOT gate can produce an inverted version of the input as an output, such as outputting a high value when the input is low. A NAND (NOT-AND) gate can produce an inverted AND output, such that the output will be high if any of the inputs are low. A NOR (NOT-OR) gate can produce an inverted OR output, such that the NOR gate output is low if any of the inputs are high. An EXOR (Exclusive-OR) gate can produce a high output if either, but not both, inputs are high. An EXNOR (Exclusive-NOR) gate can produce an inverted EXOR output, such that the output is low if either, but not both, inputs are high.

TABLE 1

Logic Gates Truth Table

| INPUTS | | OUTPUTS | | | | | | |
|---|---|---|---|---|---|---|---|---|
| A | B | NOT A | AND | NAND | OR | NOR | EXOR | EXNOR |
| 0 | 0 | 1 | 0 | 1 | 0 | 1 | 0 | 1 |
| 0 | 1 | 1 | 0 | 1 | 1 | 0 | 1 | 0 |
| 1 | 0 | 0 | 0 | 1 | 1 | 0 | 1 | 0 |
| 1 | 1 | 0 | 1 | 0 | 1 | 0 | 0 | 1 |

One of skill in the art would appreciate that the logic gates can be used in various combinations to perform comparisons, arithmetic operations, and the like. Further, one of skill in the art would appreciate how to sequence the use of various combinations of logic gates to perform complex processes, such as the processes described herein.

In an example, a 1-bit binary comparison can be performed using a XNOR gate since the result is high only when the two inputs are the same. A comparison of two multi-bit values can be performed by using multiple XNOR gates to compare each pair of bits, and the combining the output of the XNOR gates using and AND gates, such that the result can be true only when each pair of bits have the same value. If any pair of bits does not have the same value, the result of the corresponding XNOR gate can be low, and the output of the AND gate receiving the low input can be low.

In another example, a 1-bit adder can be implemented using a combination of AND gates and XOR gates. Specifically, the 1-bit adder can receive three inputs, the two bits to be added (A and B) and a carry bit (Cin), and two outputs, the sum (S) and a carry out bit (Cout). The Cin bit can be set to 0 for addition of two one bit values, or can be used to couple multiple 1-bit adders together to add two multi-bit values by receiving the Cout from a lower order adder. In an exemplary embodiment, S can be implemented by applying the A and B inputs to a XOR gate, and then applying the result and Cin to another XOR gate. Cout can be implemented by applying the A and B inputs to an AND gate, the result of the A-B XOR from the SUM and the Cin to another AND, and applying the input of the AND gates to a XOR gate.

TABLE 2

1-bit Adder Truth Table

| INPUTS | | | OUTPUTS | |
|---|---|---|---|---|
| A | B | Cin | S | Cout |
| 0 | 0 | 0 | 0 | 0 |
| 1 | 0 | 0 | 0 | 1 |
| 0 | 1 | 0 | 0 | 1 |
| 1 | 1 | 0 | 1 | 0 |
| 0 | 0 | 1 | 0 | 1 |
| 1 | 0 | 1 | 1 | 0 |
| 0 | 1 | 1 | 1 | 0 |
| 1 | 1 | 1 | 1 | 1 |

In various embodiments, computer system 500 can be coupled via bus 502 to a display 512, such as a cathode ray tube (CRT) or liquid crystal display (LCD), for displaying information to a computer user. An input device 514, including alphanumeric and other keys, can be coupled to bus 502 for communicating information and command selections to processor 504. Another type of user input device is a cursor control 516, such as a mouse, a trackball or cursor direction keys for communicating direction information and command selections to processor 504 and for controlling cursor movement on display 512. This input device typically has two degrees of freedom in two axes, a first axis (i.e., x) and a second axis (i.e., y), that allows the device to specify positions in a plane.

A computer system 500 can perform the present teachings. Consistent with certain implementations of the present teachings, results can be provided by computer system 500 in response to processor 504 executing one or more sequences of one or more instructions contained in memory 506. Such instructions can be read into memory 506 from another computer-readable medium, such as storage device 510. Execution of the sequences of instructions contained in memory 506 can cause processor 504 to perform the processes described herein. In various embodiments, instructions in the memory can sequence the use of various combinations of logic gates available within the processor to perform the processes describe herein. Alternatively hard-wired circuitry can be used in place of or in combination with software instructions to implement the present teachings. In various embodiments, the hard-wired circuitry can include the necessary logic gates, operated in the necessary sequence to perform the processes described herein. Thus implementations of the present teachings are not limited to any specific combination of hardware circuitry and software.

The term "computer-readable medium" as used herein refers to any media that participates in providing instructions to processor 504 for execution. Such a medium can take many forms, including but not limited to, non-volatile media, volatile media, and transmission media. Examples of non-volatile media can include, but are not limited to, optical or magnetic disks, such as storage device 510. Examples of volatile media can include, but are not limited to, dynamic memory, such as memory 506. Examples of transmission media can include, but are not limited to, coaxial cables, copper wire, and fiber optics, including the wires that comprise bus 502.

Common forms of non-transitory computer-readable media include, for example, a floppy disk, a flexible disk, hard disk, magnetic tape, or any other magnetic medium, a CD-ROM, any other optical medium, punch cards, paper tape, any other physical medium with patterns of holes, a RAM, PROM, and EPROM, a FLASH-EPROM, any other memory chip or cartridge, or any other tangible medium from which a computer can read.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

In various embodiments, the methods of the present teachings may be implemented in a software program and applications written in conventional programming languages such as C, C++, etc.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

The embodiments described herein, can be practiced with other computer system configurations including hand-held devices, microprocessor systems, microprocessor-based or programmable consumer electronics, minicomputers, mainframe computers and the like. The embodiments can also be practiced in distributing computing environments where tasks are performed by remote processing devices that are linked through a network.

It should also be understood that the embodiments described herein can employ various computer-implemented operations involving data stored in computer systems. These operations are those requiring physical manipulation of physical quantities. Usually, though not necessarily, these quantities take the form of electrical or magnetic signals capable of being stored, transferred, combined, compared, and otherwise manipulated. Further, the manipulations performed are often referred to in terms, such as producing, identifying, determining, or comparing.

Any of the operations that form part of the embodiments described herein are useful machine operations. The embodiments, described herein, also relate to a device or an apparatus for performing these operations. The systems and methods described herein can be specially constructed for the required purposes or it may be a general purpose computer selectively activated or configured by a computer program stored in the computer. In particular, various general purpose machines may be used with computer programs written in accordance with the teachings herein, or it may be more convenient to construct a more specialized apparatus to perform the required operations.

Certain embodiments can also be embodied as computer readable code on a computer readable medium. The computer readable medium is any data storage device that can store data, which can thereafter be read by a computer system. Examples of the computer readable medium include hard drives, network attached storage (NAS), read-only memory, random-access memory, CD-ROMs, CD-Rs, CD-RWs, magnetic tapes, and other optical and non-optical data storage devices. The computer readable medium can also be distributed over a network coupled computer systems so that the computer readable code is stored and executed in a distributed fashion.

What is claimed is:

1. A method of operating a mass spectrometer, comprising:

supplying a quantity of ions to an ion detector, the ion detector including a conversion dynode operating in a first polarity and an electron multiplier;

calibrating the gain of the electron multiplier to determine a first set of calibration parameters;

calculating a second set of calibration parameters for the electron multiplier from the first set of calibration parameters, the second set of calibration parameters being for a second polarity of the conversion dynode;

configuring the ion detector to operate at the second polarity based on the second set of calibration parameters;

calibrating the electron multiplier when the ion detector is operating in the second polarity using the second set of calculated calibration parameters as a starting point;

supplying ions of the second polarity to the mass spectrometer; and detecting an ion at a particular mass to charge ratio using the ion detector.

2. The method of claim 1, wherein the first polarity is a positive polarity and the second polarity is a negative polarity.

3. The method of claim 1, wherein the first polarity is a negative polarity and the second polarity is a positive polarity.

4. The method of claim 1, wherein the first set of calibration parameters model a gain function of the electron multiplier.

5. The method of claim 1, wherein the second set of calibration parameters is calculated to prevent saturation or overloading of the electron multiplier when the ion detector is operated in the second polarity.

6. The method of claim 1, wherein the second set of calibration parameters is calculated to ensure ion signal is sufficient for a stable ion detection and electron multiplier calibration when the ion detector is operated in the second polarity.

7. The method of claim 1, wherein the second set of calibration parameters is calculated to trigger a recalibration of the electron multiplier when the ion detector is operated in the second polarity.

8. The method of claim 1, wherein exceeding a threshold by a function of a calibrated voltage in the first polarity or by a function of a calculated voltage in the second polarity, or by a voltage offset triggers resetting calibration parameters to a safe values.

9. A mass spectrometer system comprising:

an ion source configured to ionize a sample for analysis;

a mass analyzer configured to separate ions based on a mass to charge ratio;

an ion detector including a conversion dynode and an electron multiplier, the ion detector configured to detect ions from the mass analyzer; and a controller configured to:

instruct the ion source to supply a quantity of ions to the ion detector operating at a first polarity;

calibrate the gain of the electron multiplier to determine a first set of calibration parameters;

calculate a second set of calibration parameters of the electron multiplier from the first set of calibration parameters, the second set of calibration parameters being for a second polarity of the conversion dynode, the second set of calibration parameters is calculated to trigger a calibration of the electron multiplier when the ion detector is operating in the second polarity;

configure the ion detector to operate at the second polarity based on the second set of calibration parameters;

supplying ions of the second polarity to the mass spectrometer; and detecting a plurality of ions using the ion detector.

10. The system of claim 9, wherein the controller is further configured to calibrate the electron multiplier when the ion detector is operating in the second polarity using the second set of calculated calibration parameters as a starting point.

11. The system of claim 9, wherein the first set of calibration parameters model a gain function of the electron multiplier.

12. The system of claim 9, wherein the second set of calibration parameters model a gain function of the electron multiplier.

13. The system of claim 9, wherein the second set of calibration parameters is calculated to prevent saturation or overloading of the electron multiplier when the ion detector is operated in the second polarity.

14. The system of claim 9, wherein the controller is further configured to reset calibration parameters to safe values when a function of a calibrated voltage in the first polarity, a function of a calculated voltage in the second polarity, or a voltage offset exceeds a threshold.

15. The system of claim 9, wherein the second set of calibration parameters can be calculated to ensure ion signal is sufficient for a stable ion detection and electron multiplier calibration when the ion detector is operated in the second polarity.

16. A method of operating a mass spectrometer, comprising:

supplying a quantity of ions to an ion detector, the ion detector including a conversion dynode operating in a first polarity and an electron multiplier;

calibrating the gain of the electron multiplier to determine a first set of calibration parameters;

calculating an ideal set of calibration parameters for the ion detector operating in the second polarity from the first set of calibration parameters;

retrieving a second set of calibration parameters for the ion detector operating in a second polarity;

determining if an update condition is met based on the second set of calibration parameters and the ideal set of calibration parameters;

calculating and storing a third set of calibration parameters for the ion detector operating in the second polarity if the update condition is met;

configuring the ion detector to operate at the second polarity based on the second set of calibration parameters;

supplying ions of the second polarity to the mass spectrometer; and detecting a plurality of ions at a particular mass to charge ratio using the ion detector.

17. The method of claim 16, further comprising calibrating the electron multiplier when the ion detector is operating in the second polarity using the second set of calibration parameters as a starting point.

18. The method of claim 16, wherein the update condition is met when a function of a calibrated voltage in the first polarity, a function of a calculated voltage in the second polarity, or a voltage offset exceeds a threshold.

19. The method of claim 16, wherein the first set of calibration parameters model a gain function of the electron multiplier.

20. The method of claim 16, wherein the ideal set of calibration parameters model a gain function of the electron multiplier.

21. The method of claim 16, wherein the third set of calibration parameters are calculated to prevent saturation or overloading of the electron multiplier when the ion detector is operated in the second polarity.

22. The method of claim 16, wherein the third set of calibration parameters is calculated to trigger a recalibration of the electron multiplier when the ion detector is operated in the second polarity.

23. The method of claim 16, wherein exceeding a threshold by a function of a calibrated voltage in the first polarity or by a function of a calculated voltage in the second polarity, or by a voltage offset triggers resetting calibration parameters to safe values.

24. The method of claim 16, wherein the second set of calibration parameters is calculated to ensure ion signal is sufficient for a stable ion detection and electron multiplier calibration when the ion detector is operated in the second polarity.

* * * * *